US011725444B2

(12) United States Patent
Bohle

(10) Patent No.: US 11,725,444 B2
(45) Date of Patent: Aug. 15, 2023

(54) ACTUATOR FOR MOVING A FURNITURE FLAP

(71) Applicant: Julius Blum GmbH, Hoechst (AT)

(72) Inventor: Wolfgang Bohle, Goetzis (AT)

(73) Assignee: JULIUS BLUM GMBH, Hoechst (AT)

( * ) Notice: Subject to any disclaimer, the term of this patent is extended or adjusted under 35 U.S.C. 154(b) by 186 days.

(21) Appl. No.: 17/388,289

(22) Filed: Jul. 29, 2021

(65) Prior Publication Data

US 2021/0355729 A1 Nov. 18, 2021

Related U.S. Application Data

(63) Continuation of application No. PCT/AT2020/060007, filed on Jan. 16, 2020.

(30) Foreign Application Priority Data

Jan. 31, 2019 (AT) ..... A 50082/2019

(51) Int. Cl.
*E05F 3/00* (2006.01)

(52) U.S. Cl.
CPC ..... *E05F 3/00* (2013.01); *E05Y 2201/604* (2013.01); *E05Y 2900/20* (2013.01)

(58) Field of Classification Search
CPC . E05F 3/00; E05Y 2201/1604; E05Y 2900/20
See application file for complete search history.

(56) References Cited

U.S. PATENT DOCUMENTS 4,260,045 A * 4/1981 Hack ..... B64C 13/28 192/223
4,678,042 A * 7/1987 Barton ..... A01D 34/535 72/15.1

(Continued)

FOREIGN PATENT DOCUMENTS

| | | |
|---|---|---|
| CN | 1918352 | 2/2007 |
| CN | 101142368 | 3/2008 |
| CN | 101952530 | 1/2011 |
| CN | 102209828 | 10/2011 |

(Continued)

OTHER PUBLICATIONS

Search Report dated May 5, 2022 in corresponding Chinese Patent Application No. 202080011739.6.
International Search Report dated Apr. 20, 2020 in International (PCT) Application No. PCT/AT2020/060007.

*Primary Examiner* — Victor D Batson
*Assistant Examiner* — Matthew J Sullivan
(74) *Attorney, Agent, or Firm* — Wenderoth, Lind & Ponack, L.L.P.

(57) ABSTRACT

An actuating drive includes an actuating arm pivotally supported about a pivoting axis, and movably supported between a closed position and an open position. A force storage member applies a force to the actuating arm, and a coupling device can brake or prevent a pivotal movement of the actuating arm. The coupling device includes a movably-supported first coupling element having a tooth arrangement, and the first coupling element can engage a second coupling element when a predetermined pivotal speed of the actuating arm is exceeded to brake or prevent the pivotal movement of the actuating arm. The second coupling element includes an engagement section for engaging the two coupling elements together, and includes a freewheel section separate from the engagement section. In the closed position, the first coupling element is within the freewheel section of the second coupling element, whereby the two coupling elements are decoupled from one another.

16 Claims, 6 Drawing Sheets

(56) References Cited

U.S. PATENT DOCUMENTS

| | | | | |
|---|---|---|---|---|
| 4,912,806 | A * | 4/1990 | Orii | E05F 3/00 16/64 |
| 4,984,666 | A | 1/1991 | Orii et al. | |
| 5,048,151 | A * | 9/1991 | Orii | E05F 3/16 16/64 |
| 6,725,502 | B2 * | 4/2004 | Moll | E05F 1/02 16/354 |
| 7,478,891 | B2 | 1/2009 | Hollenstein | |
| 7,562,757 | B2 * | 7/2009 | Dubach | E05F 5/00 312/319.2 |
| 8,066,341 | B2 | 11/2011 | Brustle | |
| 8,590,107 | B2 * | 11/2013 | Omann | E05D 15/401 16/319 |
| 8,696,076 | B2 | 4/2014 | Karg | |
| 8,944,021 | B2 * | 2/2015 | Kellermann | F02N 3/02 123/185.3 |
| 9,032,768 | B2 * | 5/2015 | Hauer | E05F 1/1058 70/91 |
| 9,765,558 | B2 * | 9/2017 | Talpe | E05F 3/102 |
| 10,428,568 | B2 | 10/2019 | Brunnmayr | |
| 10,591,002 | B2 * | 3/2020 | Cultraro | F16F 7/06 |
| 10,988,966 | B2 * | 4/2021 | Haemmerle | E05F 5/10 |
| 11,053,723 | B2 * | 7/2021 | Sobolewski | E05F 3/20 |
| 11,060,337 | B2 * | 7/2021 | Sobolewski | E05F 5/10 |
| 11,098,516 | B2 * | 8/2021 | Kaiser | E05F 3/18 |
| 11,525,295 | B2 * | 12/2022 | Nordieker | E05F 3/20 |
| 2006/0284530 | A1 | 12/2006 | Hollenstein | |
| 2008/0121490 | A1 | 5/2008 | Dubach et al. | |
| 2008/0122332 | A1 | 5/2008 | Brustle | |
| 2011/0193458 | A1 | 8/2011 | Omann | |
| 2011/0197639 | A1 | 8/2011 | Hauer | |
| 2011/0203122 | A1 * | 8/2011 | Holcomb | B27G 19/003 30/520 |
| 2013/0334944 | A1 | 12/2013 | Karg | |
| 2019/0003229 | A1 | 1/2019 | Brunnmayr | |
| 2020/0131818 | A1 * | 4/2020 | Sobolewski | E05D 15/40 |
| 2020/0224477 | A1 * | 7/2020 | Sobolewski | E05F 1/1276 |
| 2021/0355729 | A1 * | 11/2021 | Bohle | E05D 15/262 |
| 2022/0056747 | A1 * | 2/2022 | Holzapfel | E05F 3/22 |
| 2022/0074248 | A1 * | 3/2022 | Holzapfel | E05D 15/40 |

FOREIGN PATENT DOCUMENTS

| | | |
|---|---|---|
| CN | 103109029 | 5/2013 |
| CN | 103415671 | 11/2013 |
| EP | 0 298 514 | 1/1989 |
| JP | 1-151682 | 6/1989 |
| JP | 2-55025 | 2/1990 |
| JP | 8-319772 | 12/1996 |
| JP | 2008-525673 | 7/2008 |
| JP | 2011-514457 | 5/2011 |
| JP | 2012-507644 | 3/2012 |
| WO | 2006/069412 | 7/2006 |
| WO | 2009/108971 | 9/2009 |
| WO | 2010/051569 | 5/2010 |
| WO | 2017/152212 | 9/2017 |

* cited by examiner

ACTUATOR FOR MOVING A FURNITURE FLAP

BACKGROUND OF THE INVENTION

The present invention relates to an actuating drive for moving a furniture flap movably-supported relative to a furniture carcass, the actuating drive comprising:

- at least one actuating arm pivotally supported about a pivoting axis for moving the furniture flap, the at least one actuating arm being movably supported between a closed position corresponding to a closed position of the furniture flap relative to the furniture carcass in a mounted condition of the furniture flap, and an open position,
- a force storage member for applying a force to the at least one actuating arm, and
- a coupling device for braking or preventing a pivotal movement of the at least one actuating arm. The coupling device includes at least one movably-supported first coupling element having a tooth arrangement, and the at least one first coupling element is configured to be engaged with a second coupling element when a predetermined pivotal speed of the actuating arm is exceeded. The pivotal movement of the at least one actuating arm is braked or prevented, and the second coupling element includes at least one engagement section for engaging the two coupling elements with one another.

Moreover, the invention relates to an item of furniture comprising a furniture carcass, a furniture flap movably-supported relative to the furniture carcass, and an actuating drive of the type to be described for moving the furniture flap.

Actuating drives for moving furniture flaps usually have at least one pivotally-supported actuating arm and a force storage member in the form of a spring device for applying a force to the actuating arm. By the force storage member, the weight of the furniture flap can be at least partially compensated for. As a result, the movement of the furniture flap can be facilitated for a person. The actuating arm, depending on the size and the weight of the furniture flap, is pressurized with extremely large pre-stressing forces of the force storage member in a direction of the open position. Critical situations can arise, in particular, when the furniture flap has not yet been connected to the actuating arm. In such a case, there is no counter-weight acting on the actuating arm, whereby the actuating arm can massively kick out by the force of the force storage member, and injuries of persons and damages to objects can be caused.

WO 2006/069412 A1 and WO 2010/051569 A1 disclose actuating drives for moving furniture flaps, the actuating drives being equipped with a centrifugal clutch for preventing an uncontrolled kicking-out movement of the actuating arm in a direction of the open position. The centrifugal clutch ensures that the actuating arm, below a predetermined pivotal speed, can be moved in a controlled manner. Above the predetermined pivotal speed, an automatic locking of the actuating arm can be provided by the centrifugal clutch. As a result, the actuating arm can be locked in its pivotal position and cannot further kick out in a direction of the open position.

In practice, problems with the centrifugal clutch can arise insofar when the actuating drive has already been pre-mounted to the item of furniture, and the actuating arm is connected to the furniture carcass on the one hand and to the furniture flap on the other hand. When the furniture flap is located in a closed position relative to the furniture carcass, it may occur that the coupling elements of the centrifugal clutch inadvertently get jammed with one another, for example by a transport of by a tilting movement of the furniture carcass upon its mounting operation. The actuating arm, due to the blocked centrifugal clutch, is arrested in its closed position and can no longer be moved in a direction of the closed position, because the furniture flap bears against the furniture carcass. Therefore, the jamming of the centrifugal clutch and the blockage of the actuating arm cannot be released. An opening movement of the furniture flap is then frequently only possible with resultant damage of the furniture flap or of the actuating drive.

SUMMARY OF THE INVENTION

It is an object of the present invention to propose an actuating drive of the type mentioned in the introductory part, thereby avoiding the above-discussed drawbacks.

According to the invention, the second coupling element includes a least one freewheel section separate from the engagement section, wherein the first coupling element, in the closed position of the actuating arm, is arranged within the freewheel section of the second coupling element, whereby the two coupling elements are decoupled from one another in the closed position of the actuating arm.

In other words, the second coupling element includes at least one freewheel section configured to prevent an engagement, in particular a positive locking, of the two coupling elements to one another in the closed position of the actuating arm and/or in a pivoting range immediately preceding the closed position of the actuating arm.

In the closed position of the actuating arm, the first coupling element is configured to bear against the freewheel section of the second coupling element. The surface of the freewheel section can be configured substantially toothless or substantially smooth. The freewheel section can also have a different surface finish. However, it shall be ensured that a locking between the two coupling elements is not possible in the closed position of the actuating arm.

According to an embodiment, by the freewheel section of the second coupling element, the two coupling elements are decoupled from one another within a pivoting angle range of the actuating arm resulting between the closed position of the actuating arm and an opening position of the actuating arm of maximum 30°, preferably maximum 20°.

According to an embodiment of the invention, the second coupling element includes a substantially annular-shaped inner contour, and both of the engagement section and the freewheel section are arranged or formed on the annular-shaped inner contour of the second coupling element.

The engagement section of the second coupling element can include, for example, a counter-toothing configured to lock the first coupling element in a form-locking manner. On the contrary, the freewheel section can form a substantially smooth surface on which the first coupling element, in the closed position of the actuating arm, can bear against.

BRIEF DESCRIPTION OF THE DRAWINGS

Further details and advantages of the present invention result from the following description of figures.

DETAILED DESCRIPTION OF THE INVENTION

Figure 1:
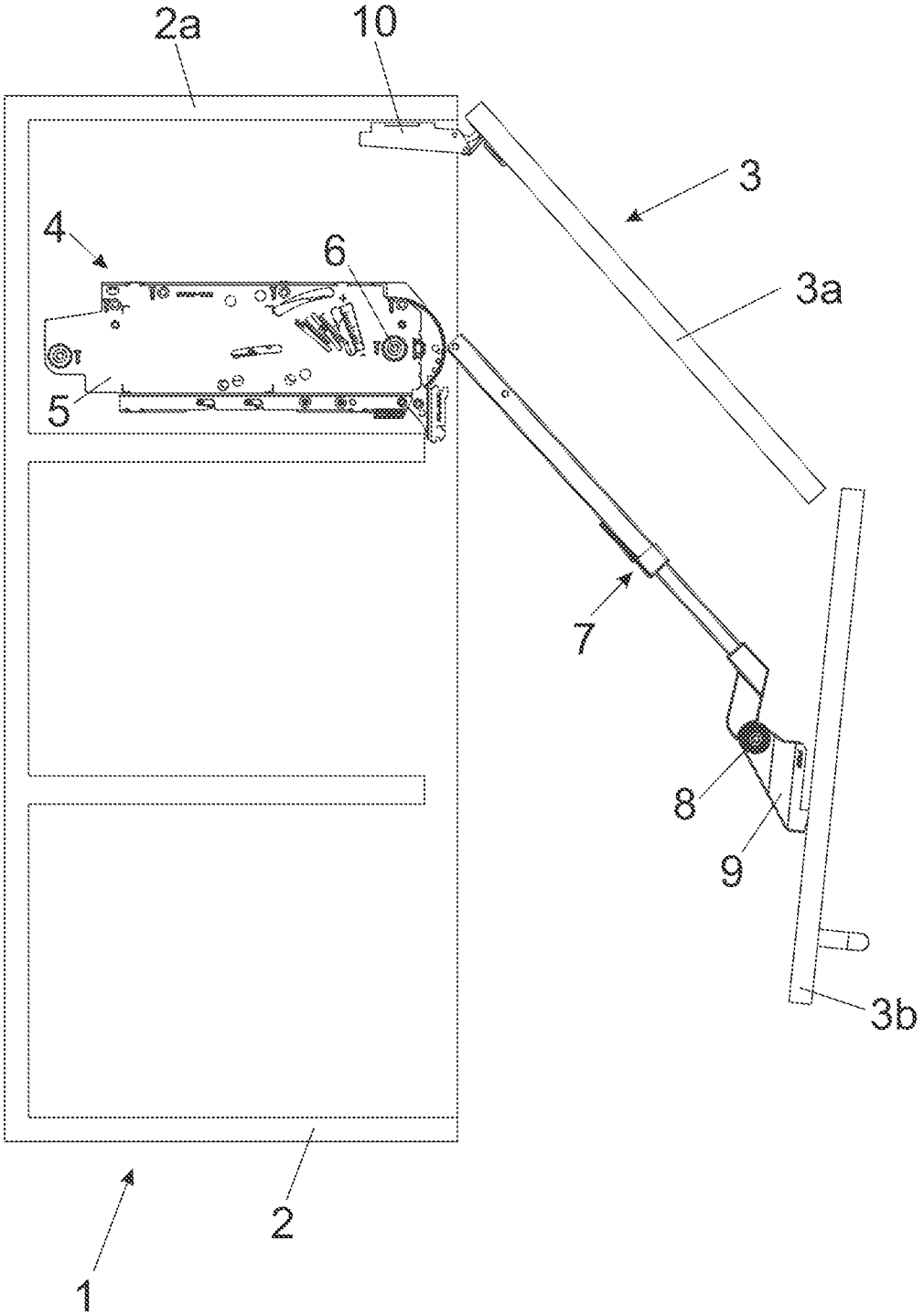
FIG. 1 is a side view of an item of furniture with a furniture carcass, a furniture flap located in an open position and with an actuating drive for moving the furniture flap.

FIG. 1 shows an item of furniture 1 with a furniture carcass 2 in a side view, in which a furniture flap 3 is movably-supported relative to the furniture carcass 2 by an actuating drive 4. In the shown embodiment, the furniture flap 3 has a two-part configuration and includes a first partial flap 3*a* pivotally fixed to an underside of a cover panel 2*a* of the furniture carcass 2 via hinges 10. The second partial flap 3*b* is hingedly connected to the first partial flap 3*a*. The actuating drive 4 includes a housing 5 configured to be fixed to the furniture carcass 2, and at least one actuating arm 7 for moving the furniture flap 3, the at least one actuating arm 7 being pivotally supported on the housing 5. It can be preferably provided that actuating arm 7 is configured to be adjustable in length. The actuating arm 7 is pivotally connected to a fitting portion 9 via a hinge axis 8, and the fitting portion 9 is configured to be fixed to an inner side of the second partial flap 3*b*, preferably via a mounting plate.

Figure 2:
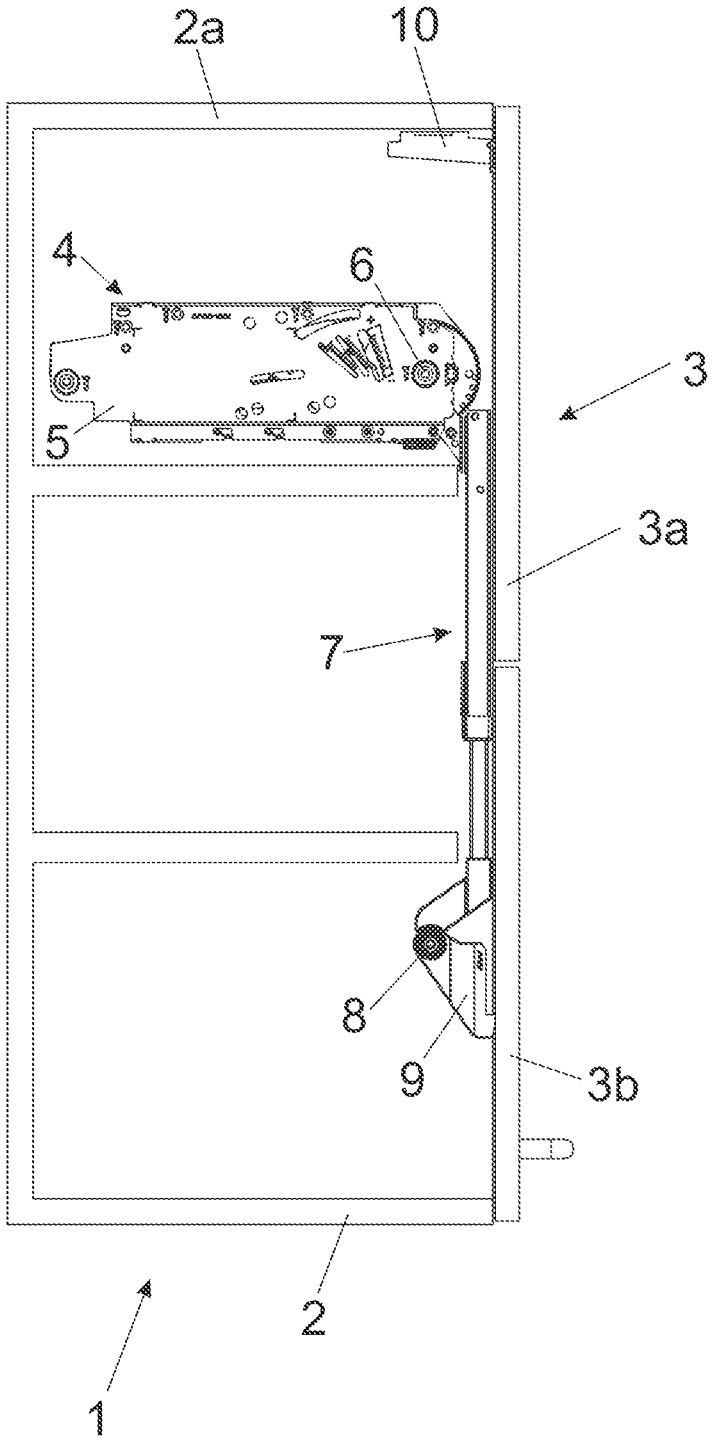
FIG. 2 shows the item of furniture according to FIG. 1, in which the furniture flap achieves a closed position relative to the furniture carcass.

FIG. 2 shows a side view of the item of furniture 1 according to FIG. 1, and the furniture flap 3 is in a closed position in relation to the furniture carcass 2. The actuating drive 4 includes a force storage member 11 (FIG. 3*a*) for applying a force to the actuating arm 7, whereby the weight of the furniture flap 3 can be at least partially compensated for. Moreover, the actuating drive 4 includes a coupling device 19 (not shown here) for braking or preventing a pivotal movement of the at least one actuating arm 7. Therefore, an inadvertent opening or kicking-out movement of the vacant actuating arm 7, on which no furniture flap 3 has yet been fitted, caused by the force of the force storage member 11 acting in an opening direction, can be prevented. When the furniture flap 3 is in a fixed condition on the actuating arm 7, the coupling device 19 is not active. This is because the pivotal speed of the actuating arm 7, with a furniture flap 3 fixed to the actuating arm 7, is always far below a predetermined critical value. However, the coupling device 19 of the actuating drive 4, in the shown closed position of the furniture flap 3, can get jammed. As a result, the furniture flap 3 can neither be moved in the opening direction nor in the closing direction, and the jamming of the coupling device 19 cannot be released.

Figure 3A:
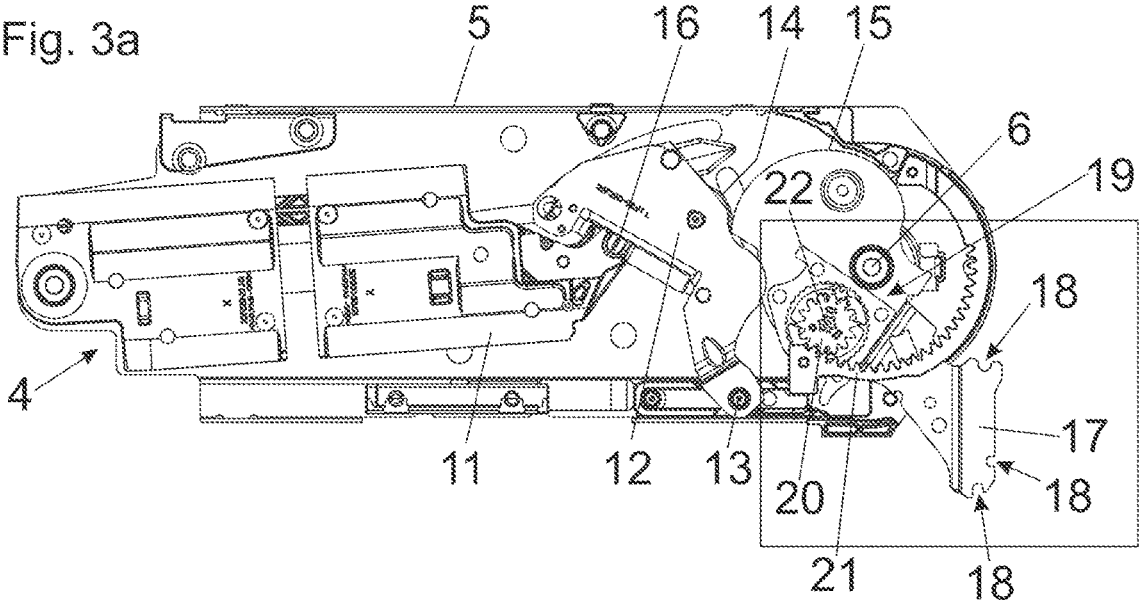
FIG. 3*a*-3*c* show the actuating drive in a side view and two enlarged detail views thereof, the actuating arm being in a closed position.

FIG. 3*a* shows a side view of the actuating drive 4 with the housing 5 configured to be fixed to the furniture carcass 2. The actuating arm 7 (not shown here) can be releasably connected to a coupling portion 17 pivotable about the pivoting axis 6. For fixing the actuating arm 7 in a form-locking manner, the coupling portion 17 has a plurality of recesses 18. For applying a force to the actuating arm 7, a force storage member 11 is provided. The force storage member 11 can include at least one helical spring, for example at least one compression spring or at least one tension spring. According to a preferred embodiment, the force storage member 11 includes a spring assembly having a plurality of compression springs arranged in a parallel relationship. The force storage member 11 is movably connected to an intermediate lever 12 via an engagement location 16, the intermediate lever 12 being pivotable about a pivoting axis 13. A pressure roller 14 is rotatably supported on the intermediate lever 12. A control contour 15 is formed on the coupling portion 17, and the pressure roller 14 of the intermediate lever 12 is configured to run along the control contour 15 of the coupling portion 17 upon a movement of the actuating arm 7 about the pivoting axis 6.

The actuating drive 4 includes a coupling device 19 for braking or preventing a pivotal movement of the at least one actuating arm 7, whereby an inadvertent kicking-out movement of the actuating arm 7, caused by a force of the force storage member 11 applied to the actuating arm 7 in a direction of the open position, can be prevented. For example, the coupling device 19 can include a centrifugal clutch. The coupling device 19 is configured to be driven by a gear 20 rotatable about a rotational axis 22, and the gear 20 is configured to run along a, preferably curved-shaped, toothed rack 21 upon a movement of the actuating arm 7 about the pivoting axis 6. The toothed rack 21 is formed or arranged on the housing 5 of the actuating drive 4. The gear 20 and the toothed rack 21 form a step-up gearing, by which a pivotal speed of the actuating arm 7, over a range of the pivoting path of the actuating arm 7, can be transmitted into a higher pivotal speed of a shaft 30 (FIG. 6*a*) supported on the rotational axis 22. With a transmission ratio of the step-up gearing of 1:4, this means that an angle change of the actuating arm 7 of 15° leads to a fourfold angle change of the shaft 30 supported on the rotational axis 22. Accordingly, the shaft 30 is thereby rotated about 60°. In this way, the reaction time of the coupling device 19 configured as a centrifugal clutch can be significantly reduced.

Figure 3B:
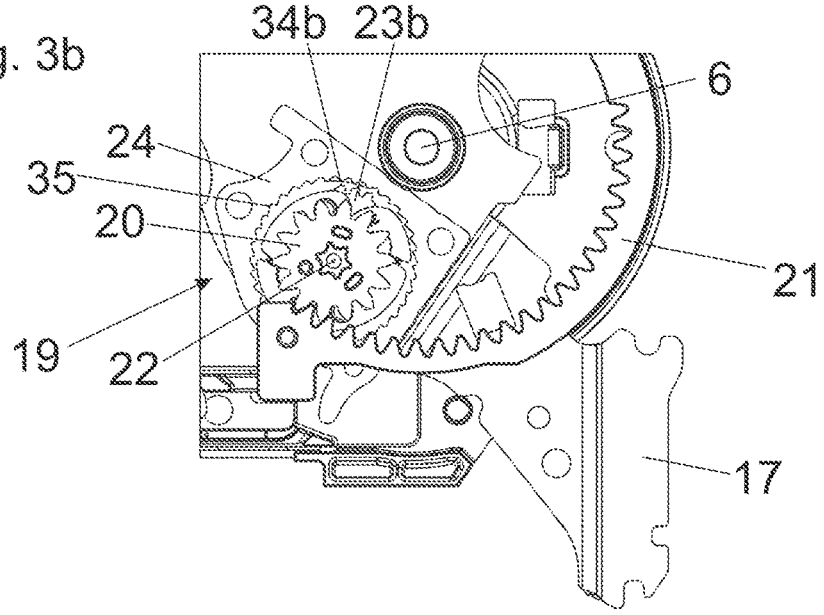

FIG. 3*b* shows the framed region of FIG. 3*a* in an enlarged view. Upon a movement of the actuating arm 7 (that is to say upon a movement of the coupling portion 17), the gear 20 can run along the toothed rack 21. The coupling device 19 includes at least one movably-supported first coupling element 23*a*, 23*b* (FIG. 3*c*) which, upon exceeding a predetermined pivotal speed of the actuating arm 7, is configured to be engaged with a second coupling element 24, whereby the pivotal movement of the actuating arm 7 can be braked or prevented.

Figure 3C:
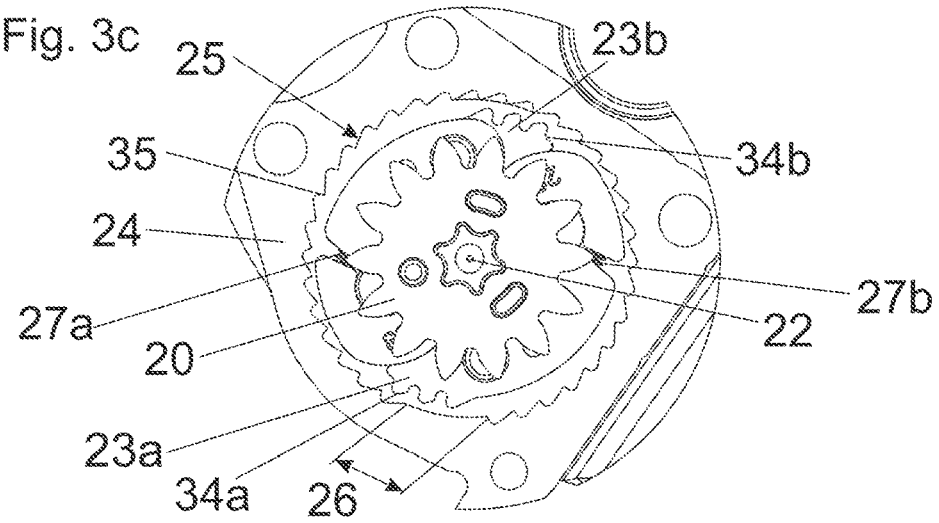

FIG. 3*c* shows the coupling device 19 in an enlarged view. Two first coupling elements 23*a*, 23*b* are arranged on a common shaft 30 configured to be rotatable about the rotational axis 22. The two first coupling elements 23*a*, 23*b* are mutually spaced from one another in an axial direction of the shaft 30, and can be driven by the gear 20 running along the toothed rack 21. Each of the coupling elements 23*a*, 23*b* includes a tooth arrangement 34*a*, 34*b* configured to be locked with a counter-toothing 35 of an engagement section 25 arranged on the second coupling element 24 in a form locking manner, if the actuating arm 7 exceeds a predetermined pivotal speed. It can be seen that at least one freewheel section 26 is arranged on the second coupling element 24, the freewheel section 26 being configured to prevent a locking of the first coupling element 23*a* with the second coupling element 24 in the shown closed position of the actuating arm 7. In the exemplary case that the angle range of the freewheel section 26 extends over an angle range of 28°, a locking of the actuating arm 7, with the already-mentioned transmission ratio of 1:4, within an angle range of 7°, is not possible. The freewheel section 26 can include a curved-shaped, smooth contour which is free from recesses or elevations.

The first coupling elements 23*a*, 23*b* are pre-stressed by spring elements 27*a*, 27*b* in a direction of an uncoupled position from the second coupling element 24. The spring elements 27*a*, 27*b* are provided for pressing the coupling elements 23*a*, 23*b* into a compact rest position and to provide a defined release force. Only after overcoming the defined release force, the two first coupling element 23*a*, 23*b* can be releasably locked with the second coupling element 24.

Figure 4A:
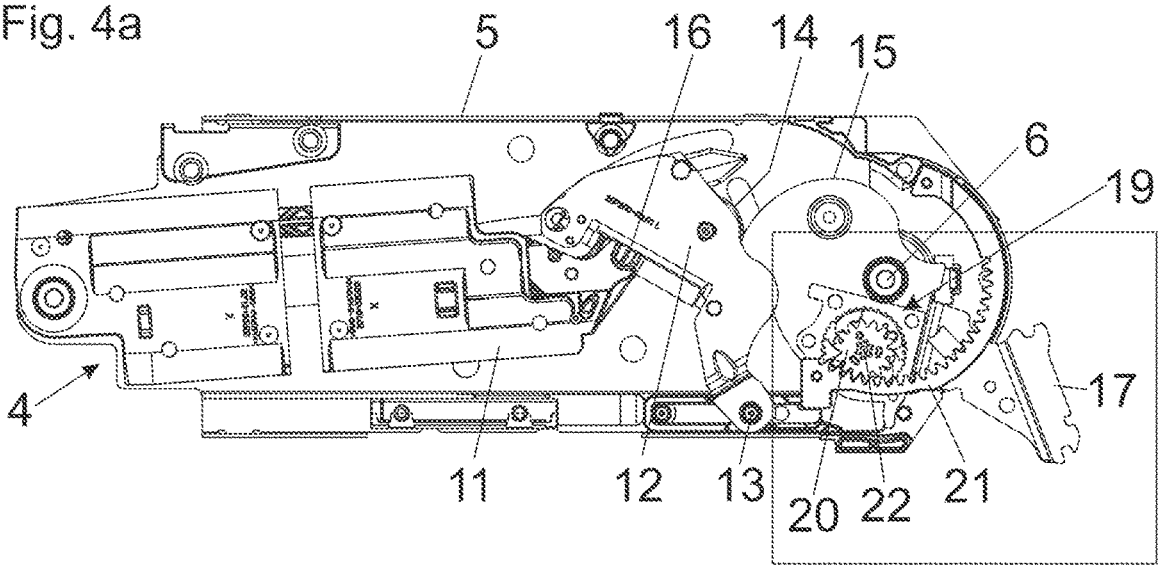
FIG. 4*a*-4*c* show the actuating drive in a side view and two enlarged detail views thereof, the actuating arm being in a locked open position.
Figure 4B:
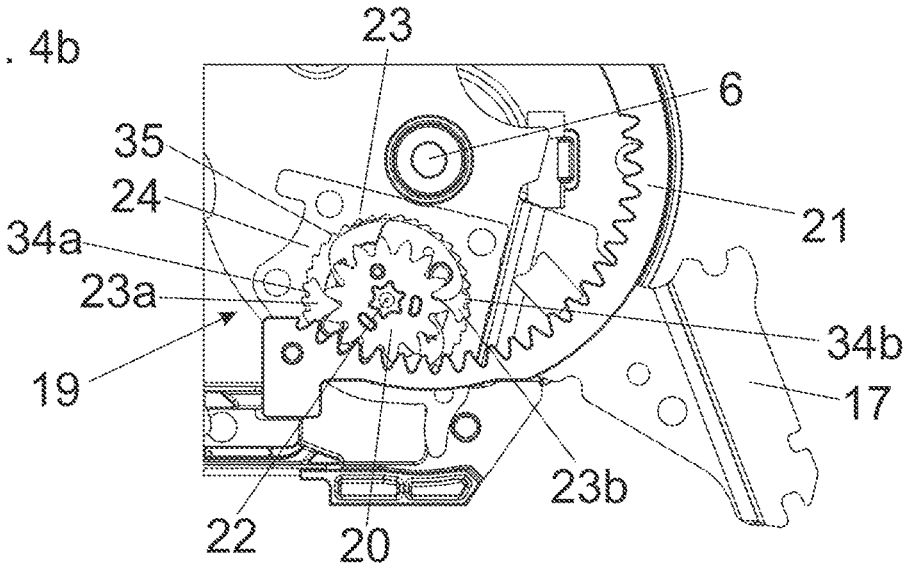

FIG. 4*a* shows a side view of the actuating drive 4, in which the actuating arm 7 (that is to say the coupling portion 17) is locked by the coupling device 19 in an open position of approximately 20°. FIG. 4*b* shows the framed region of FIG. 4*a* in an enlarged view, in which the actuating arm 7, upon exceeding the predetermined pivotal speed, is locked in a form-locking manner due to the locking of the two first coupling elements 23*a*, 23*b* with the second coupling element 24. From the position shown in FIG. 4*b*, the locking of the actuating arm 7 can be released such that the actuating arm 7 is manually pushed in a direction of the closed position. The two first coupling elements 23*a*, 23*b* can then be unlocked from the second coupling element 24 by a force of the spring elements 27*a*, 27*b*.

Figure 4C:
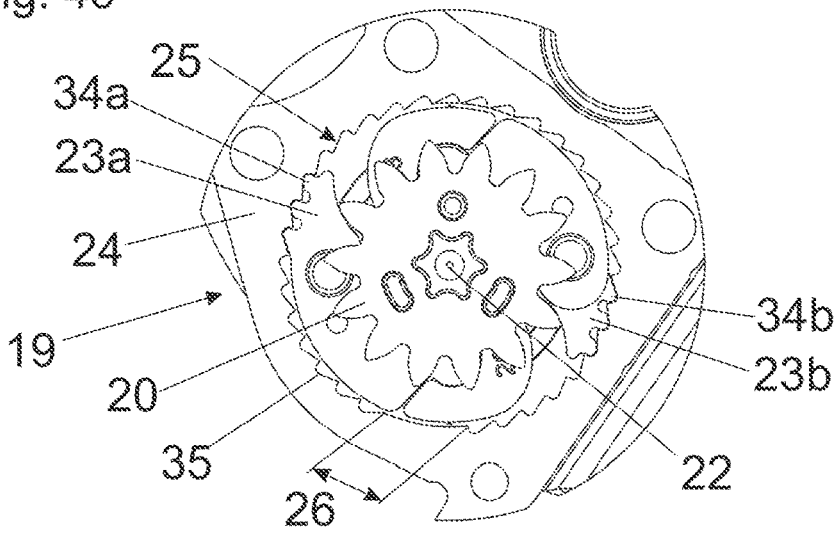

FIG. 4*c* shows an enlarged view of the coupling device 19, in which the tooth-arrangements 34*a*, 34*b* of the first coupling elements 23*a*, 23*b* engage into the counter-toothing 35 of the engagement section 25 of the second coupling element 24. The engagement section 25 can extend, for example, over an angle range of 330°, whereas the freewheel section 26 extends over 30°.

Figure 5A:
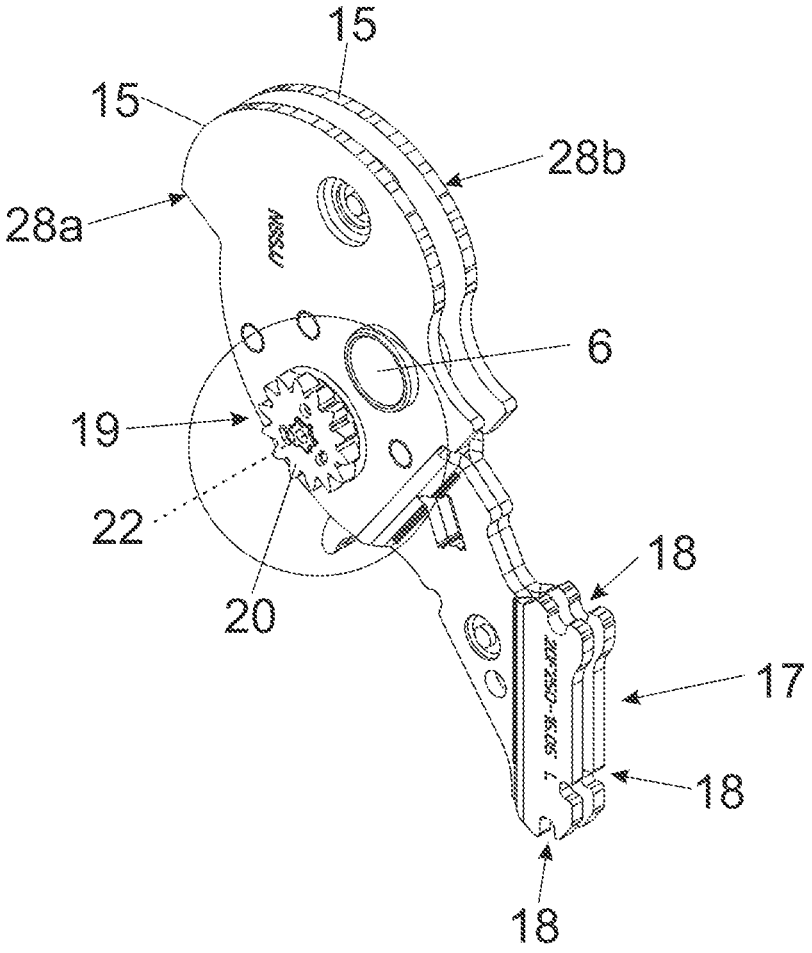
FIG. 5*a*, 5*b* is a perspective view of a coupling portion of the actuating drive, the coupling portion being configured to be connected to the actuating arm, and an enlarged detail view thereof.
Figure 5B:
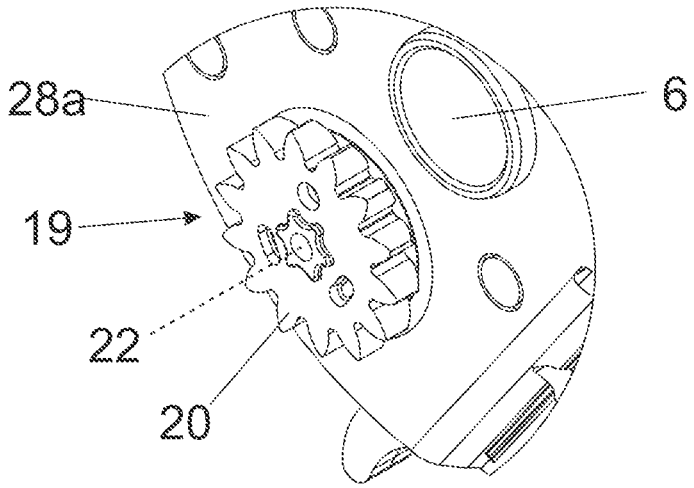

FIG. 5*a* shows a perspective view of the coupling portion 17 of the actuating drive 4, the coupling portion 17 being configured to be connected to the actuating arm 7. The coupling portion 17 includes a plurality of recesses 18 configured to receive possible fastening elements of the actuating arm 7, in particular pins and/or a spring-loaded tilting lever of the actuating arm 7, in a mounted condition of the actuating arm 7. The control contour 15 for the displaceable support of the pressure roller 14 is formed by a peripheral edge of two disc portions 28*a*, 28*b* which are mutually spaced from one another in a parallel relationship. The actuating arm 7, jointly with the coupling portion 17, is pivotally supported about the pivoting axis 6, and the gear 20 rotatable about the rotational axis 22 is configured to run along the curved-shaped toothed rack 21 of the actuating drive 4. The actuating arm 7, to which no furniture flap 3 has yet been fitted, is configured to be locked by the locking device 19 in a form-locking manner upon exceeding a predetermined pivotal speed. The pivoting axis 6 of the actuating arm 7 and the rotational axis 22 of the gear 20 are mutually spaced from one another in a substantially parallel relationship. FIG. 5*b* shows the encircled region of FIG. 5*a* in an enlarged view.

Figure 6A:
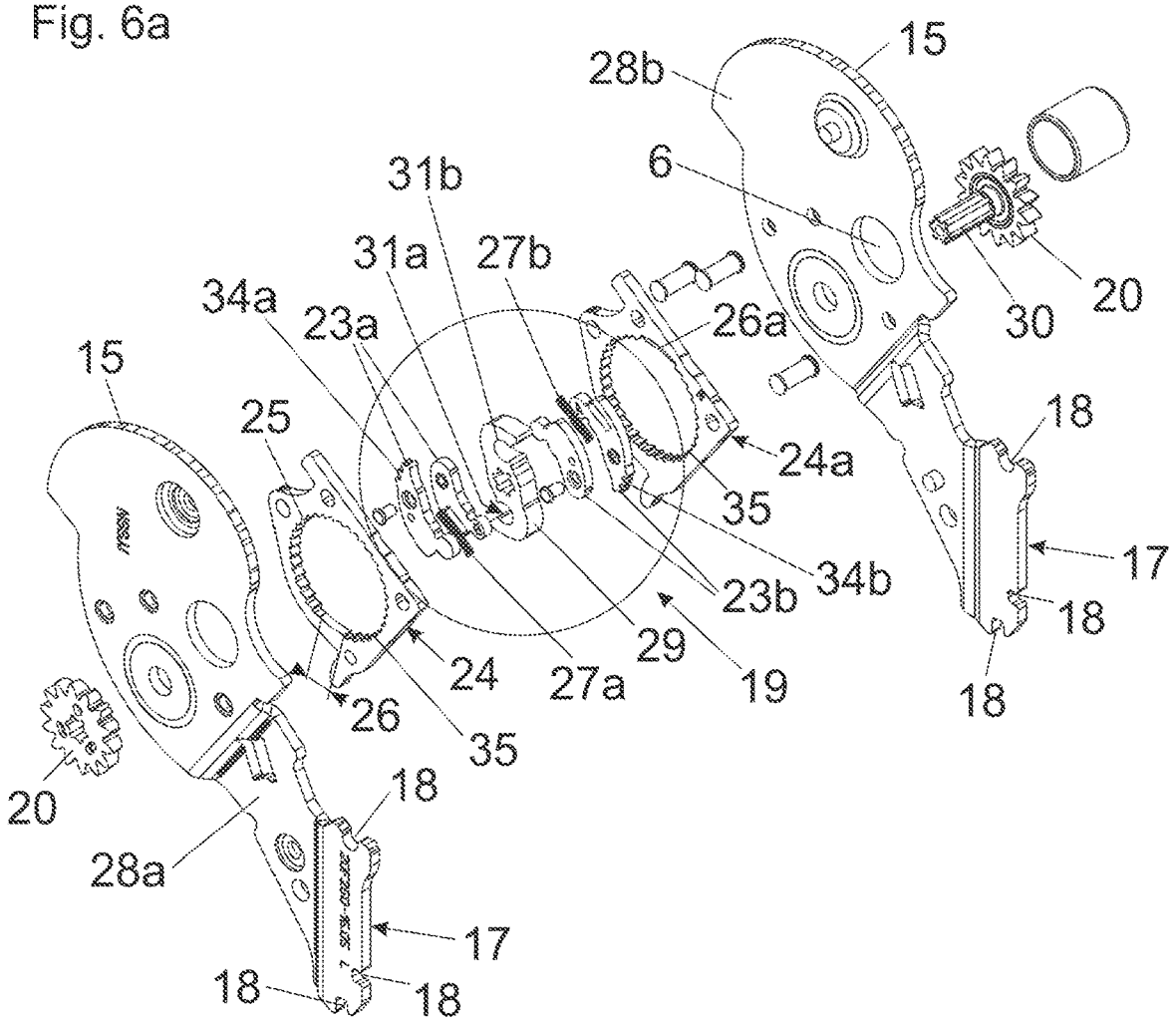
FIG. 6*a*, 6*b* shows the coupling device in an exploded view and an enlarged detail view thereof.

FIG. 6*a* shows the coupling device 19 in an exploded view, the coupling device 19 being received between the two disc portions 28*a*, 28*b* and being configured to pivot about the pivoting axis 6 upon a pivotal movement of the actuating arm 7. Gears 20 are arranged on both sides of the disc portions 28*a*, 28*b*, each of the gears 20 meshing with toothed rack 21 (FIG. 3*a*). The gears 20 are movement-coupled to one another by the shaft 30, and a rotatable rotor 29 is arranged on the shaft 30 for movably supporting the first coupling elements 23*a*, 23*b*. The first coupling elements 23*a*, 23*b* are arranged offset by 180° on the rotor 29. The rotor 29 includes two pivot bearings 31*a*, 31*b* for supporting the first coupling elements 23*a*, 23*b*. The second coupling element 24 includes an engagement section 25 for releasably locking the first coupling element 23*a*, and a freewheel section 26 separate from the engagement section 25. The freewheel section 26 is configured to prevent a locking between the first coupling element 23*a* and the second coupling element 24 when the actuating arm 7 is in the closed position. The other coupling element 23*b* is spaced from the coupling element 23*a* in an axial direction of the shaft 30, and the coupling element 23*b* is configured to be engaged with a further second coupling element 24*a*. The further coupling element 24*a* also includes a freewheel section 26*a*, the freewheel section 26*a* being arranged offset by 180° relative to the freewheel section 26 of the other coupling element 24.

Figure 6B:
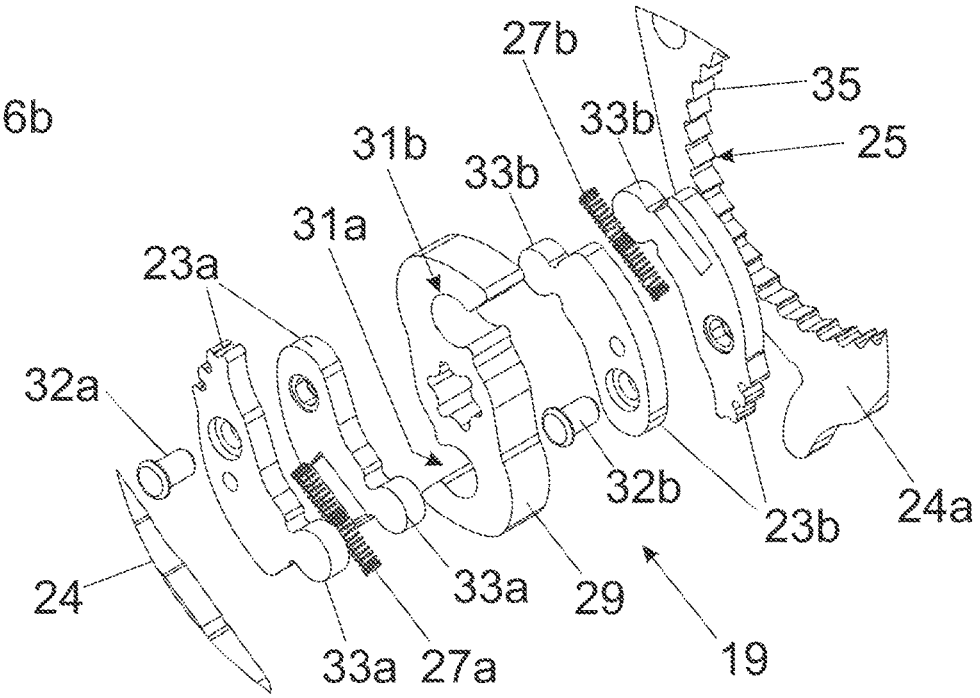

FIG. 6*b* shows the encircled region of FIG. 6*a* in an enlarged view. Each of the first coupling elements 23*a*, 23*b* has a two-part configuration and are each connected to one another by rivets 32*a*, 32*b*. The rotor 29 includes two pivot bearings 31*a*, 31*b* configured to receive pivot portions 33*a*, 33*b* of the first coupling elements 23*a*, 23*b*.

The invention claimed is:

1. An actuating drive for moving a furniture flap movably-supported relative to a furniture carcass, the actuating drive comprising:

an actuating arm pivotally supported about a pivoting axis for moving the furniture flap, the actuating arm being movably supported between a closed position corresponding to a closed position of the furniture flap relative to the furniture carcass in a mounted condition of the furniture flap, and an open position;

a force storage member for applying a force to the actuating arm; and a coupling device for braking or preventing a pivotal movement of the actuating arm, the coupling device including a movably-supported first coupling element having a tooth arrangement, and a second coupling element, wherein the first coupling element is configured to be engaged with the second coupling element when a predetermined pivotal speed of the actuating arm is exceeded, whereby the pivotal movement of the actuating arm is braked or prevented, and the second coupling element includes an engagement section for engaging the first and second coupling elements with one another, wherein the second coupling element includes a freewheel section separate from the engagement section, wherein the first coupling element, in the closed position of the actuating arm, is arranged within the freewheel section of the second coupling element, whereby the first and second coupling elements are decoupled from one another in the closed position of the actuating arm, and wherein by the freewheel section of the second coupling element, the first and second coupling elements are decoupled from one another within a pivoting angle range of the actuating arm, the pivoting angle range extending from the closed position of the actuating arm to a position in which the actuating arm is pivoted a maximum of 30° from the closed position toward the open position.

2. The actuating drive according to claim 1, wherein the pivoting angle range extends from the closed position of the actuating arm to a position in which the actuating arm is pivoted a maximum of 20° from the closed position toward the open position.

3. The actuating drive according to claim 1, wherein the first coupling element is movably supported on a rotor, the rotor being rotationally supported about a rotational axis.

4. The actuating drive according to claim 3, wherein the rotor includes at least one pivot bearing for receiving a pivot portion of the first coupling element.

5. The actuating drive according to claim 3, wherein the rotational axis of the rotor and the pivoting axis of the actuating arm are mutually spaced from one another in a parallel relationship.

6. An actuating drive for moving a furniture flap movably-supported relative to a furniture carcass, the actuating drive comprising:

an actuating arm pivotally supported about a pivoting axis for moving the furniture flap, the actuating arm being movably supported between a closed position corresponding to a closed position of the furniture flap relative to the furniture carcass in a mounted condition of the furniture flap, and an open position;

a force storage member for applying a force to the actuating arm; and a coupling device for braking or preventing a pivotal movement of the actuating arm, the coupling device including a movably-supported first coupling element having a tooth arrangement, and a second coupling element, wherein the first coupling element is configured to be engaged with the second coupling element when a predetermined pivotal speed of the actuating arm is exceeded, whereby the pivotal movement of the actuating arm is braked or prevented, and the second coupling element includes an engagement section for engaging the first and second coupling elements with one another, wherein the second coupling element includes a freewheel section separate from the engagement section, wherein the first coupling element, in the closed position of the actuating arm, is arranged within the freewheel section of the second coupling element, whereby the first and second coupling elements are decoupled from one another in the closed position of the actuating arm, and wherein the first coupling element is pre-stressed by a force of a spring element in a direction of a decoupled position from the second coupling element.

7. The actuating drive according to claim 1, wherein the actuating drive includes a step-up gearing for transmitting a pivotal speed of the actuating arm, over at least a region of a pivoting path of the actuating arm, into a higher rotational speed of the first coupling element.

8. The actuating drive according to claim 7, wherein the step-up gearing includes at least one gear for driving the first coupling element, the gear being configured to be moved along a toothed rack of the actuating drive upon a pivotal movement of the actuating arm about the pivoting axis.

9. The actuating drive according to claim 1, wherein the first coupling element includes a tooth arrangement and the engagement section of the second coupling element includes a counter-toothing, wherein the tooth arrangement of the first coupling portion and the counter-toothing of the second coupling element are configured to be engaged with one another in a form-locking manner.

10. An actuating drive for moving a furniture flap movably-supported relative to a furniture carcass, the actuating drive comprising:

an actuating arm pivotally supported about a pivoting axis for moving the furniture flap, the actuating arm being movably supported between a closed position corresponding to a closed position of the furniture flap relative to the furniture carcass in a mounted condition of the furniture flap, and an open position;

a force storage member for applying a force to the actuating arm; and a coupling device for braking or preventing a pivotal movement of the actuating arm, the coupling device including a movably-supported first coupling element having a tooth arrangement, and a second coupling element, wherein the first coupling element is configured to be engaged with the second coupling element when a predetermined pivotal speed of the actuating arm is exceeded, whereby the pivotal movement of the actuating arm is braked or prevented, and the second coupling element includes an engagement section for engaging the first and second coupling elements with one another, wherein the second coupling element includes a freewheel section separate from the engagement section, wherein the first coupling element, in the closed position of the actuating arm, is arranged within the freewheel section of the second coupling element, whereby the first and second coupling elements are decoupled from one another in the closed position of the actuating arm, wherein the second coupling element includes a substantially annular-shaped inner contour, and wherein both of the engagement section and the freewheel section are arranged or formed on the annular-shaped inner contour of the second coupling element.

11. The actuating drive according to claim 1, wherein the first coupling element is one of two first coupling elements of the coupling device, the second coupling element is one of two second coupling elements of the coupling device, each of the two second coupling elements having an engagement section, and wherein the two first coupling elements are configured to be engaged with the engagement sections of the two second coupling elements, respectively.

12. The actuating drive according to claim 11, wherein the two first coupling elements are arranged offset on the rotor by 180°.

13. An item of furniture comprising a furniture carcass, a furniture flap movably-supported relative to the furniture carcass, and the actuating drive according to claim 1 for moving the furniture flap.

14. The item of furniture according to claim 13, wherein the furniture flap covers the furniture carcass in a closed position, and achieves an elevated position relative to the furniture carcass in an open position.

15. The actuating drive according to claim 8, wherein the toothed rack of the actuating drive has a curved shape.

16. The actuating drive according to claim 9, wherein the counter-toothing has a curved shape.

* * * * *